United States Patent [19]

Gamboa

[11] 4,024,599

[45] May 24, 1977

[54] SHOE CLEANER MACHINE

[75] Inventor: Carlos E. Gamboa, Paterson, N.J.

[73] Assignee: The Raymond Lee Organization, Inc., New York, N.Y. ; a part interest

[22] Filed: Dec. 29, 1975

[21] Appl. No.: 644,551

[52] U.S. Cl. ..... 15/311; 15/34

[51] Int. Cl.² ..... A47L 23/22

[58] Field of Search ..... 15/30–37, 15/311

[56] References Cited

UNITED STATES PATENTS

| | | | |
|---|---|---|---|
| 722,679 | 3/1903 | Dagger | 15/36 |
| 2,463,153 | 3/1949 | Conklin | 15/36 |
| 2,533,781 | 12/1950 | Fallowfield, Jr. | 15/36 |
| 2,565,894 | 8/1951 | Stotz | 15/36 X |
| 2,895,159 | 7/1959 | Ostrow | 15/36 X |
| 3,445,875 | 5/1969 | Bohannon | 15/36 |

*Primary Examiner*—Edward L. Roberts
*Attorney, Agent, or Firm*—Howard I. Podell

[57] ABSTRACT

A machine for cleaning the bottom of a wearer's shoes. The machine is mounted in a free-standing housing fitted with a platform on which the user stands. An endless motorized belt, fitted with bristles, is mounted under the platform to project through cut out sections of the platform covered by a grill upon which the user stands. A fan is mounted in the housing to carry debris removed by the bristles into a removable bag located in the housing.

1 Claim, 4 Drawing Figures

SHOE CLEANER MACHINE

SUMMARY OF THE INVENTION

My invention is a machine for cleaning the bottom of a wearer's shoes. The machine is mounted in a free-standing housing fitted with a platform on which the user stands. An endless motorized belt, fitted with bristles, is mounted under the platform to project through cut out sections of the platform covered by a grill upon which the user stands. A fan is mounted in the housing to carry debris removed by the bristles into a removable bag located in the housing.

Use of my invention immediately upon entering a home, from the outdoors, will protect the carpets and floor of the home from dirt and debris normally tracked into a house.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
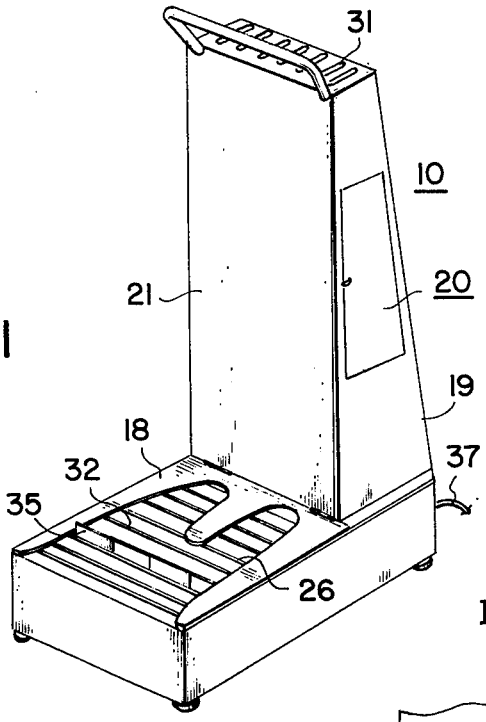
FIG. 1 is a perspective view of the invention.
Figure 2:
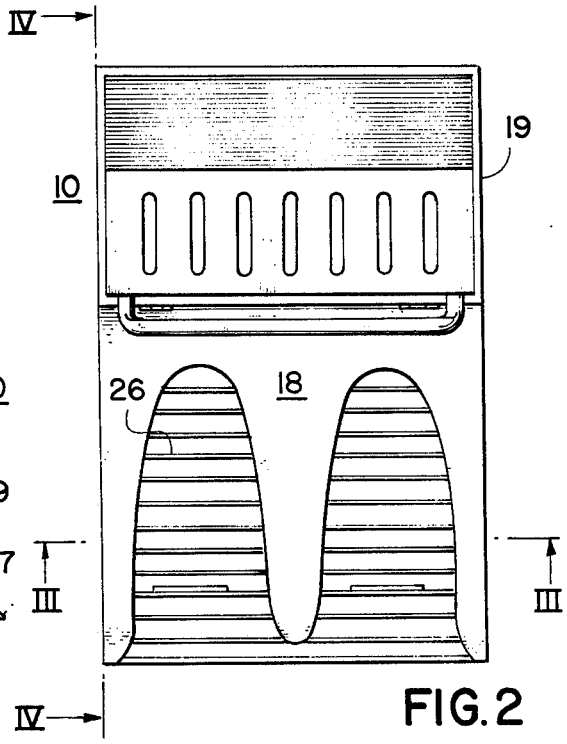
FIG. 2 is a plan view of the invention.
Figure 3:
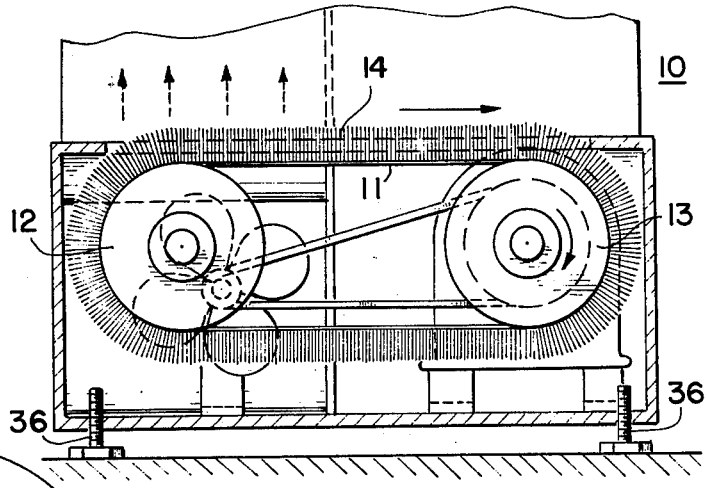
FIG. 3 is a sectional view of the invention, taken along line III—III of FIG. 1.
Figure 4:
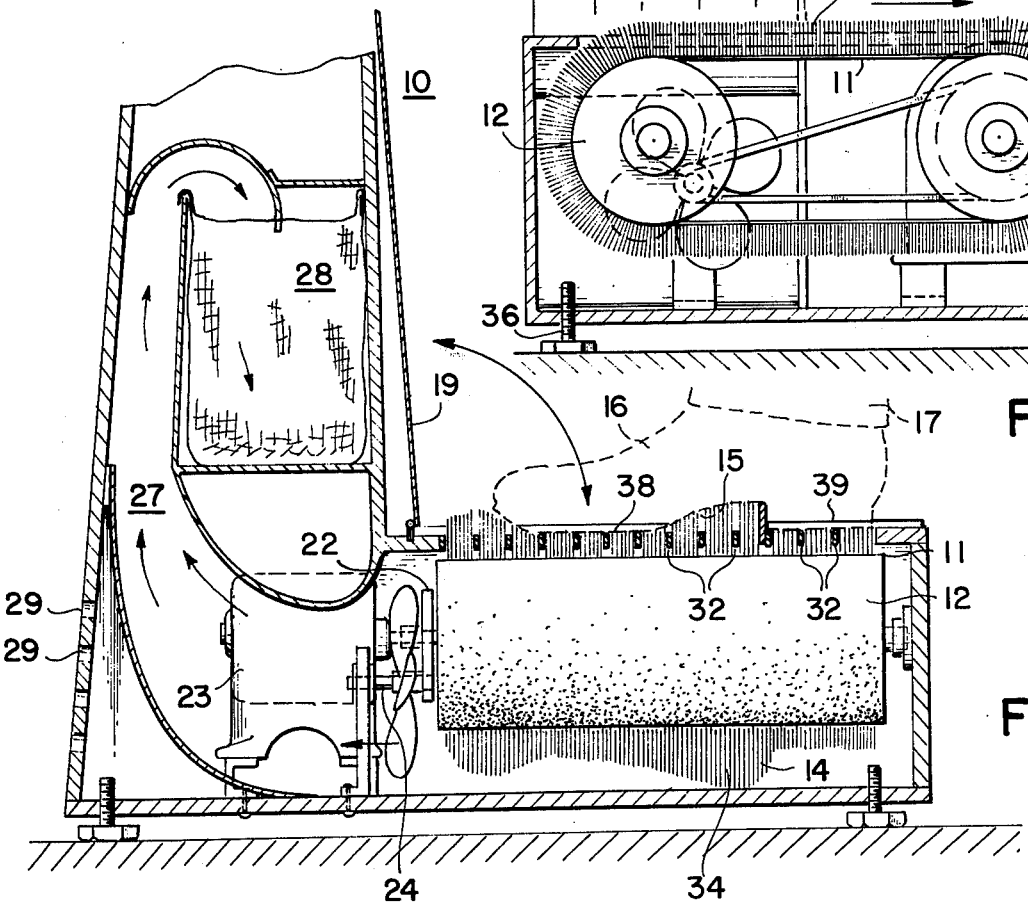
FIG. 4 is a sectional view of the invention, taken along line IV—IV of FIG. 1.

Turning now descriptively to the drawings, in which similar reference characters denote similar elements throughout the several views, FIGS. 1–4 illustrate the machine 10 which is fitted internally with an endless belt 11 mounted about a pair of rollers 12 and 13 on which bristles 14 are externally mounted for cleaning the undersides 15 of a pair of shoes 16 worn by a wearer 17 standing on the platform 18 of the machine 10.

The machine 10 is enclosed in a housing 19 and is formed of a vertical section 21 fixed to a platform 18 that extends away from the vertical section 21.

Roller 12 is joined by a drive belt 22 to the shaft 24 of a motor 23, with fan blade 25 fixed to shaft 24 and located so as to draw in air through an open shaped grill section 26 in the floor of platform 18 and expel the air through a chute 27 into a mesh bag 28 fitted in the housing 19, with the air passing through bag 28 and out of the housing by means of vent sections 29 and 31 in the housing walls.

Grill section 26 is formed of parallel spaced rods 32 oriented in the direction of travel of belt 11 with belt bristles 14 of a length to project beyond rods 32 to reach all surfaces of the undersides of a shoe 16 resting externally on grill section 26. The bristles may be of various lengths to extend a greater distance in the section 34 of belt 14 that is located between the sole 38 and heel 39 of a shoe 16 resting on the grill section 26, with the heel 39 resting against a spaced stop 35 projecting above a grill rod 32.

The motor 23 may be connected by an external portable line cord 37 to a convenient outlet and may be controlled by a switch (not shown).

Leveling screws 36 are mounted to the base of the housing to adjust the level of platform 18.

A door 20 is hinged to a side of the housing 19 to provide access to mesh bag 28 for removal and replacement purposes.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A machine for cleaning the undersides of a shoe worn by a person standing on the machine, comprising a housing shaped with an extended platform, an open grill section formed in said platform of a size to fit about the undersides of a pair of shoes, together with projecting stop means mounted to said grill so as to orient a shoe on said grill section along a first axis when the heel of said shoe is rested against said stop means, a belt mounted on a pair of rollers and fitted with bristles projecting from the external surface of the belt, said belt mounted under the platform with the bristles extending through the grill, motorized means to rotate one of said rollers to drive said belt along a direction of travel normal to said first axis, said means serving to also rotate a fan inside the housing located so as to draw in air through the grill, and a strainer bag located in the housing in a position to receive air expelled by the fan and capture entrapped debris in the air, bring grill being formed of spaced rods oriented generally parallel to the direction of travel of the belt, along a second axis generally normal to said first axis, with said bristles formed of different lengths so as to generally match the profile of the undersurface of a shoe resting on said grill and bearing against the stop.

* * * * *